United States Patent [19]

Rubbo

[11] Patent Number: 4,936,387

[45] Date of Patent: Jun. 26, 1990

[54] METHOD AND APPARATUS FOR COMPLETION OF A HORIZONTAL WELL

[75] Inventor: Richard P. Rubbo, The Woodlands, Tex.

[73] Assignee: Baker Hughes Incorporated, Houston, Tex.

[21] Appl. No.: 345,106

[22] Filed: Apr. 28, 1989

[51] Int. Cl.[5] ..... E21B 33/128

[52] U.S. Cl. ..... 166/387; 166/120; 166/122; 166/187

[58] Field of Search ..... 166/382, 386, 120, 122, 166/132, 125, 187, 297, 381, 383, 123; 285/82, 306, 922, 920; 175/4.52

[56] References Cited

U.S. PATENT DOCUMENTS

| | | | |
|---|---|---|---|
| 3,181,614 | 5/1965 | Brown | 166/122 |
| 3,460,616 | 8/1969 | Tucker et al. | 166/120 |
| 4,224,987 | 9/1980 | Allen | 166/120 |
| 4,526,229 | 7/1985 | Dickerson | 166/120 |
| 4,655,298 | 4/1987 | George et al. | 175/4.52 |
| 4,667,735 | 5/1987 | Salerni et al. | 175/4.52 |
| 4,688,641 | 8/1987 | Knieriemen | 166/120 |
| 4,834,175 | 5/1989 | Ross et al. | 166/120 |

*Primary Examiner*—Bruce M. Kisliuk

*Attorney, Agent, or Firm*—Hubbard, Thurman, Turner & Tucker

[57] ABSTRACT

A hydraulic packer with seals and slips is actuated by first and second cylinders which move in a first direction to actuate the seals or the slips into setting position with primary and secondary pistons carried within the cylindrical members and tandemly arranged for movement in a second direction to activate the other of the seals and slips. The pistons are selectively secured against longitudinal movement relative to the housing and to each other and the primary piston is released from the housing before release of the secondary piston.

28 Claims, 6 Drawing Sheets

METHOD AND APPARATUS FOR COMPLETION OF A HORIZONTAL WELL

BACKGROUND OF THE INVENTION (1) Field of the Invention

The invention is directed to a hydraulically set packer mechanism having particular application for use in horizontal sections of deviated subterranean wells, the packer mechanism including an emergency disconnect at the top of the apparatus and a releasing mechanism at the bottom.

(2) Brief Description of the Prior Art

Subsequent to the drilling of a subterranean oil or gas well, a string of tubular conduit commonly referred to as "casing" is run into the well. Thereafter, the casing is cemented into place. After the cementing operation, it is necessary to perforate the well so that production fluids within the production zone may flow from the production zone, through holes perforated through the cement behind the casing, into holes in the casing, and through the well bore to the top of the well.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation.

Most production formations have a substantial horizontal portion and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total drilling costs in the field may be substantially decreased. Additionally, after a particular horizontal wellbore has produced all of the economically available hydrocarbons, the same vertical wellbore may be re-drilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In some aspects, the present invention is not limited to use in horizontal completions of deviated wells and can be used in conventional or straight hole subterranean wells.

In co-pending application Ser. No. 345,107, filed on the same date as the present application, entitled "Method and Apparatus for Selective Retraction of a Tubing Carried Perforating Gun", there is disclosed an apparatus having particular utility for use in horizontal completions of subterranean wells for retracting tubing carried perforating guns. That apparatus is intended to be utilized with a completion packer mechanism which is carried into the well on a tubular workstring, the workstring having positioned thereabove a service retrievable packer. Because of the deviation of such horizontal wells, it is quite desirable that the setting mechanism for any permanent packer be hydraulically actuated, thus eliminating the reliance on tubular manipulation during the setting procedure.

The present invention provides a particularly unique packer assembly having particular utility for use in such completion operations and having a tandem piston arrangement operating in concert with companion cylinders for actuating the seal assembly and the anchoring means, or, preferably, slip assembly. The present invention also provides an emergency disconnect provided at the top of the apparatus for disconnecting the apparatus in the event that it becomes stuck in the well, or it is otherwise essential to quickly withdraw the tubular work or other string from the well, leaving the packer either in secured position in the well, or dropped to the bottom thereof if it is unsecured at the time of the emergency disconnect procedure. The invention also contemplates a mechanical release mechanism for actuation in the event that it is desired to release the packer subsequent to acidizing or otherwise remedially treating the formation which has been subsequently perforated.

SUMMARY OF THE INVENTION

The present invention provides a hydraulically set packer mechanism for use in a subterranean well. The apparatus comprises a tubular housing which is carryable in the well on a tubular conduit and is telescopically positionable within a second conduit in said well. Typically, the second conduit will be a string of casing, or casing liner. A seal assembly is disposed around the housing and is carried in the well in initially retracted position and is activatable into expanded position within the well to sealing securement relative to the inner wall of the second conduit. Anchoring means are provided for securing the packer mechanism in position within the second conduit and are activatable to securing condition to resist movement of the packer mechanism relative to the second conduit in at least one direction. First and second cylindrical members of the tubular housing are movable in a first direction to actuate one of the seal assembly and the anchoring means into engagement with the second conduit. Primary and secondary piston means are carried within the cylindrical members and are tandemly arranged and movable in a second direction to actuate the other of the seal assembly and the anchoring means and are responsive to pressure introduced through the tubular conduit. A mechanically actuated release mechanism is also provided which is preferably manipulatable by an auxiliary tubular member disposed through the tubular conduit and the apparatus for shifting of a sleeve member to release a collet mechanism for unsetting of the packer assembly.

The invention also provides a disconnect system having upper and lower outer housing members, the lower of the housing members comprising a housing of the packer element. Key and slot means are interengagingly juxtapositioned around said housing members for preventing relative rotational movement therebetween. A collet assembly is positioned interiorly of the housing member and carried with the upper housing member by the tubular conduit and latchingly secures the housing members together. A lock sleeve is responsive to annulus/tubing pressure differential and is hydraulically urgeable against the collet assembly to urge the collet assembly in latchingly secured positioned and shiftable by a variation in pressure within the tubular conduit to release the lock sleeve relative to the collet assembly and release the upper housing member from the lower housing member. The piston means are secured relative to the housing against longitudinal movement and to each other, whereby upon release of the piston means from the housing, the piston means and cylinder members are movable to actuate the seal assembly and the anchoring means.

DESCRIPTION OF THE PREFERRED EMBODIMENTS

Figure 1:
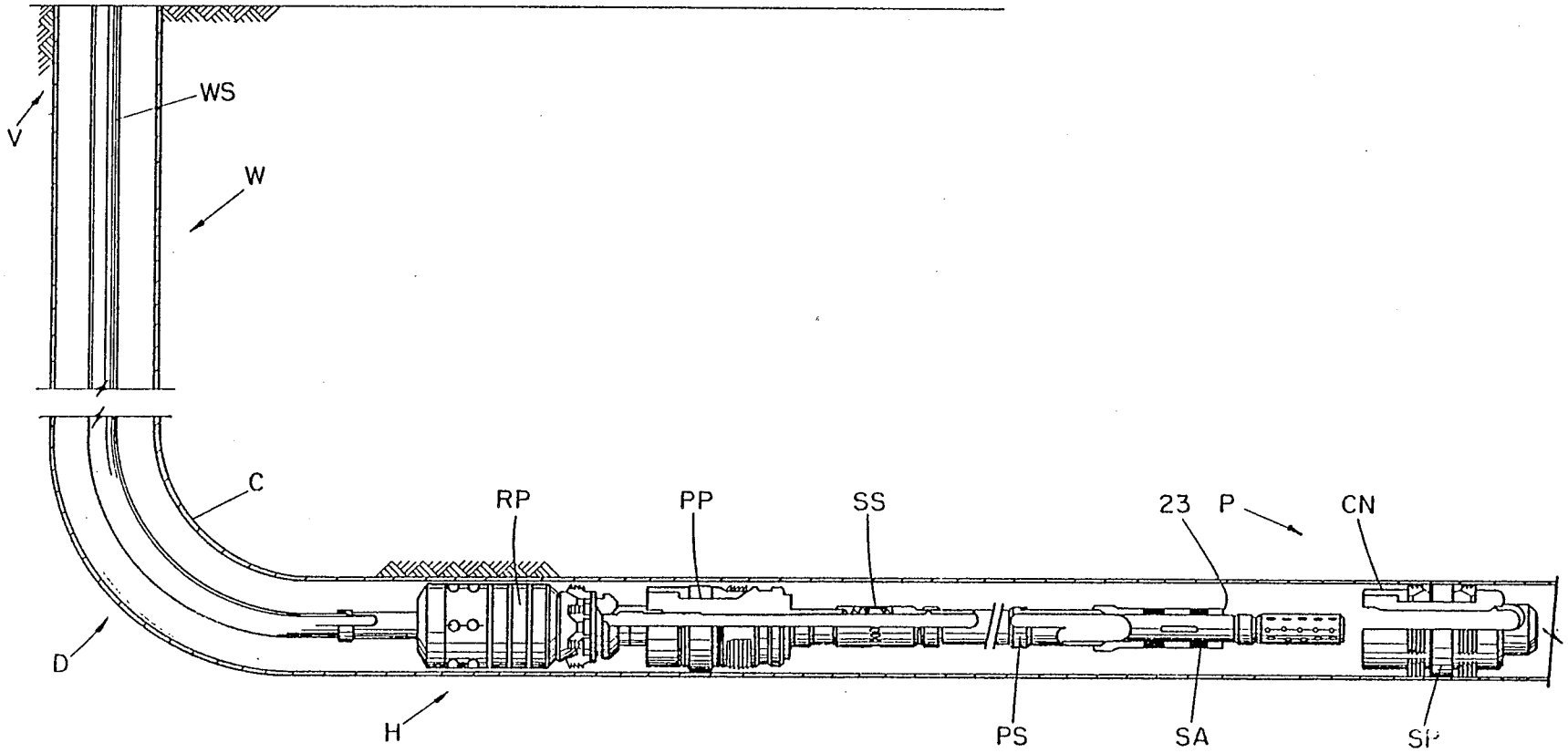
FIG. 1 is a schematic illustration of a subterranean well incorporating the apparatus of the present invention on a workstring in a horizontal section of a deviated well.

With reference to FIG. 1, there is shown a subterranean well W having a first vertical section V communicating with the top of the well and extending into a deviation or curvature thereof D which, in turn, extends into a horizontal secton H traversing a production zone P. Prior to running the workstring WS carrying a retrievable packer RP and a permanent packer PP, the casing C has been placed into the well and cemented therein. The casing C will have perforations therethrough subsequent to the firing of the perforating gun 21.

A section of production string PS extends from and is carried on the workstring WS below the permanent packer PP with a seal assembly SA circumferentially extending around the exterior of the section of production string PS approximate the end 23 thereof for selective stabbing within the interior of a connector CN extending upwardly from a sump packer SP positioned and set within the well W below the production zone P. A sliding sleeve mechanism SS is provided on the production string PS and is placed initially in the open position to permit communication between the production string-casing annulus and the interior of the production string PS.

Figure 2A:
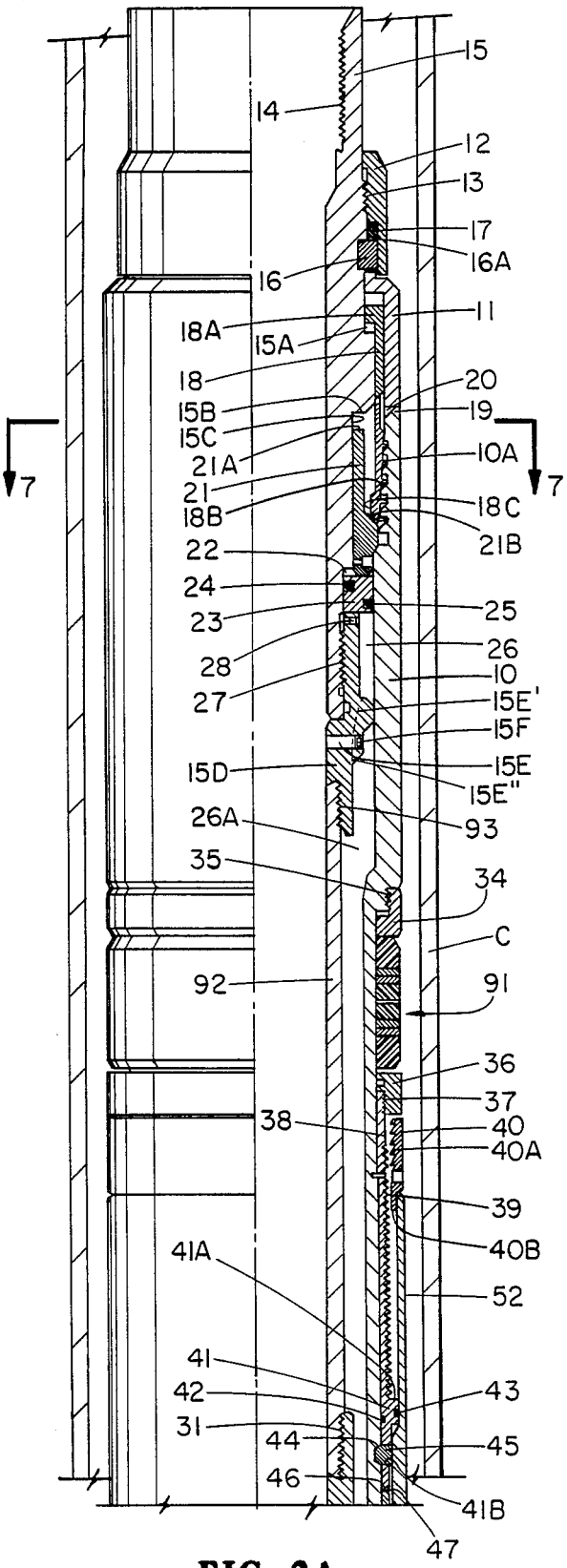
FIGS. 2A and 2B are longitudinal sectional views illustrating the apparatus of the present invention as it is run into the well, prior to the setting of the packer mechanism.
Figure 2B:
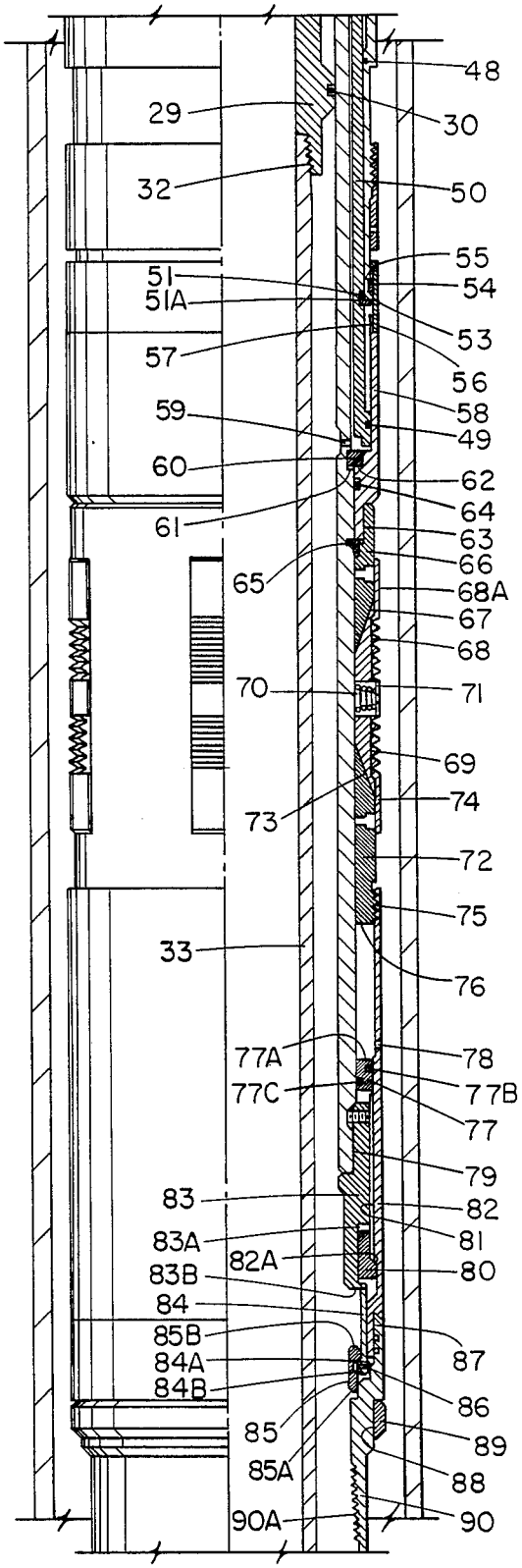
Figure 3A:
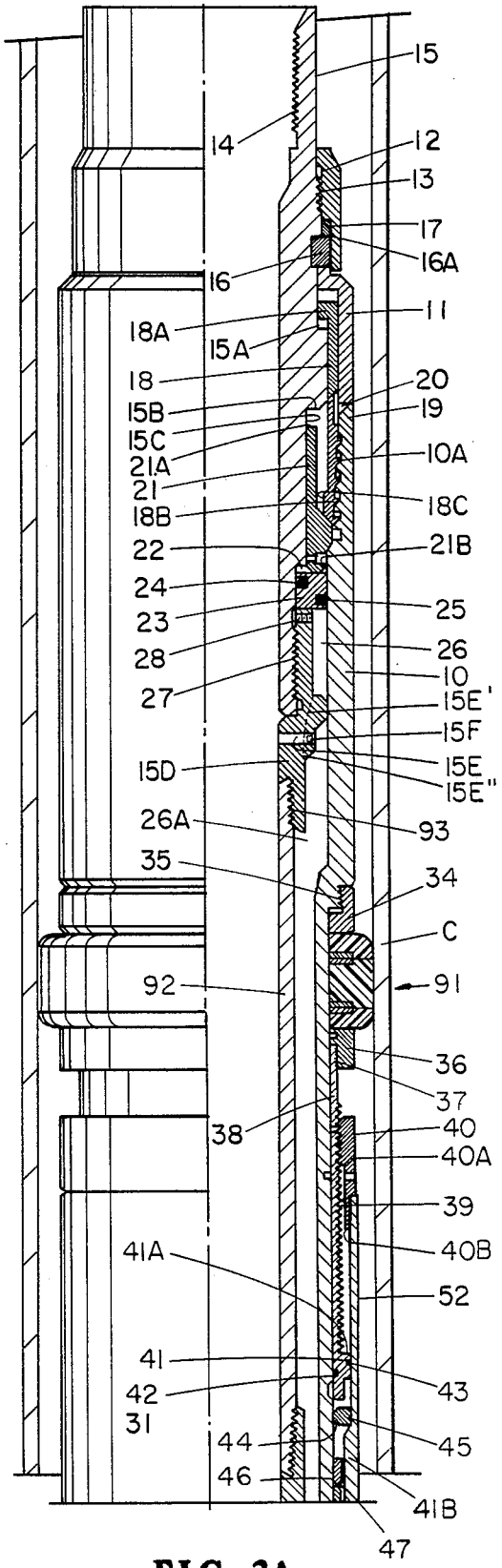
FIGS. 3A and 3B are sectional views similar to that of FIGS. 2A and 2B, illustrating the apparatus of the present invention as it is set within the well.
Figure 3B:
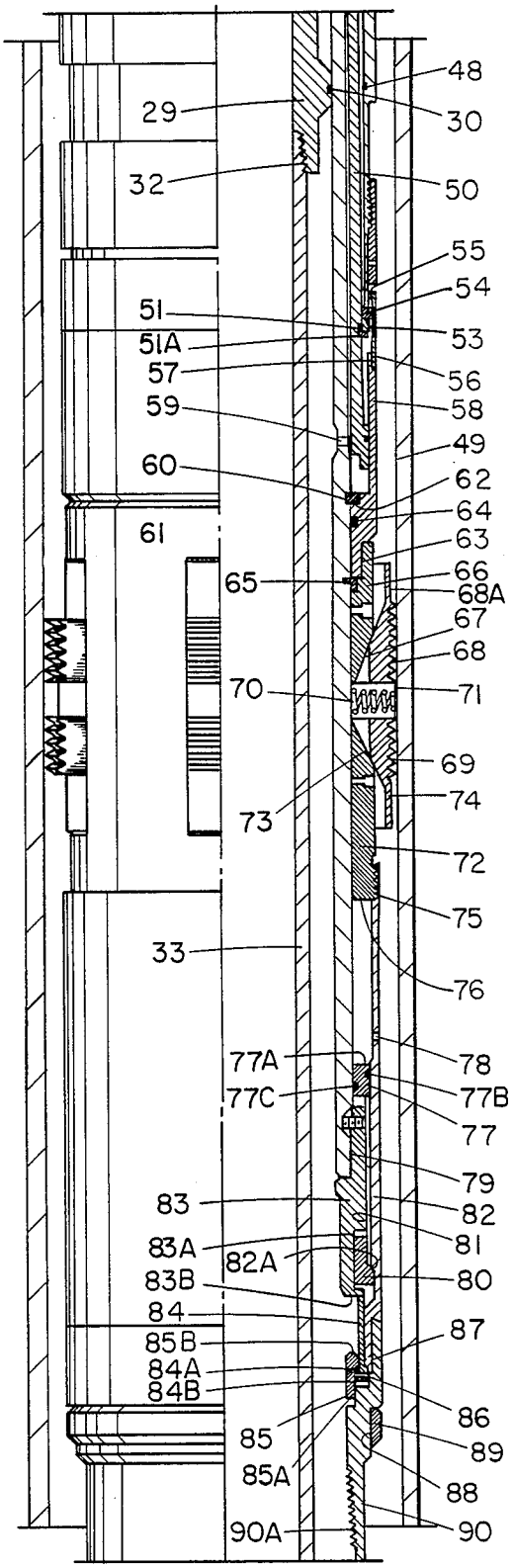

Now referring to FIGS. 2A and 2B, there is shown the production packer PP of the present invention as it is positioned within the well W on the workstring WS within the deviated portion D of the well W and above or ahead of the production zone P.

The production packer PP is secured by threads 14 at its uppermost end to a section of tubular conduit or workstring WS. The threads 14 are placed interiorly around an upper extension of an upper body member 15 which is secured to a key housing 12 by means of threads 13. A key lock member 17 is carried interiorly of the key housing 12 and above a key 16 keyed into a splineway **16*a* therefore to prevent relative rotationa movement between the upper body member 15 and an upper housing member 11 extending from the splineways 16*a***.

Figure 6:
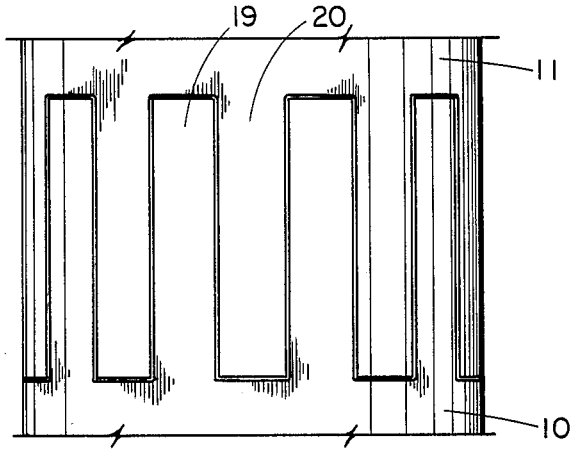
FIG. 6 is an exterior planar view showing the slot and key means of the disengaging apparatus of the present invention.
Figure 7:
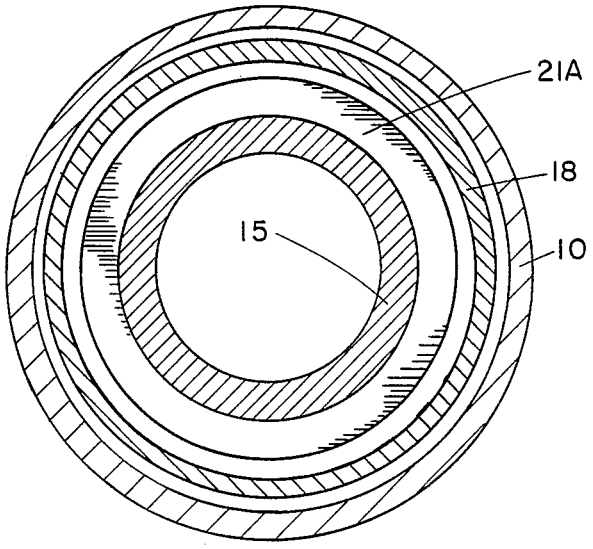
FIG. 7 is a sectional view taken along lines 7—7 of FIG. 2A.

The upper housing member 11 is matingly engaged to a central housing member 10 extending therebelow by a slot and key configuration 20, 19 shown in exterior in FIG. 6. By means of such key and slot assembly 20, 19, the upper housing member 11 and the central housing member 10 are interengaged one to another and cannot rotate relative to each other. The upper housing member 11 and central housing member 10 also are secured one to another by means of a collet 18 having a collet head **18*a* extending adjacent the upper body member 15 and on a shoulder 15*a*. The collet 18 has a series of serrated finger elements extending interiorly of the central housing member 10 with threads 18*b* thereon being matingly secured to threads 10*a* on the central housing member 10**.

An inwardly facing smooth locking shoulder **18*c* on the collet 18 is initially urged toward the threads 10*a* by means of a locking surface 21*b* of a locking sleeve 21 which is urged into engagement relative to the collet 18 by contact of its upper face 21*a* with the lower shoulder 15*b* on the upper body member 15 by means of the upward urging of a piston member 23, discussed below. The locking sleeve 21 is held in position against the collet 18 by means of the inner face of the shoulder 18*c* and the lock surface 21*b* and by the positioning of the locking sleeve 21 along the smooth outer wall 15*c* of the upper body member 15**.

Below the locking sleeve 21 and defined between the exterior of the upper body member 15 and the interior of the central housing member 10 is a annulus pressure chamber 22 acting on the upper face of a sliding piston 23 having an O-ring seal 25 for smooth interegagement with the inner wall of the central housing member 10 and a similar O-ring 24 carried around the interior of the piston 23 for smooth sealing contact with the outer wall of the upper body member 15. The piston 23 separates the annulus pressure chamber 22 thereabove from the upper tubing pressure chamber 26 defined therebelow.

The upper tubing pressure chamber 26 is defined at its uppermost end by means of the seal elements 24, 25 on the piston 23 and at its lowermost end by an O-ring element 30 on a piston head 29 carried on a tubing extension 92 and secured thereto by means of threads 31, the extension 92 being secured at its uppermost end by means of threads 93 to a seal housing **15*d*. The uppermost end of the seal housing 15*d* is secured at threads 27 and set screw 28 to the upper body member 15**.

The seal housing 15d has a flow passage 15e communicating with the interior of the upper body member 15 for transmission of hydraulic pressure within the tubular conduit and workstring WS for maintaining the locking sleeve 21 in its uppermost position for engaging the collet 18 in engaged position with the upper housing member 11. Fluid is permitted to pass interiorly of the seal housing 15 through the passage 15e and through a ported elastomer 15f which filters sand and other particulate debris and provides a diaphragm. Fluid then may pass into the upper tubing pressure chamber 26 through the upper passage 15e' (shown in dotted lines in FIG. 2A) and also into the lower tubing pressure chamber 26a below the seal housing 15d through the lower passage 15e'' (shown in dotted lines in FIG. 2A).

The piston head 29 is secured by threads 32 to a tubular extension 33 carried lowerly through the production packer PP and extending to the perforating gun and other apparatuses (FIG. 1).

The seal assembly 91 is carried exteriorly around the central housing member 10 and is comprised of a series of elastomeric elements and metallic or other backup rings. The seal assembly 91 is of a known construction and may take a variety of forms well known to those skilled in the art. The uppermost end of the seal assembly 91 contacts the lowermost face of an upper gauge ring 34 secured at threads 35 to the central housing member 10. A similar lower gauge ring 36 is not secured to the central housing member 10, but, rather, is secured by means of threads 37 to the secondary piston sleeve 38 which is carried interiorly of the lower gauge ring 36, a body lock ring 40 therebelow and a piston cylinder 52 secured by means of threads to the body lock ring 40.

The secondary piston sleeve 38 has a series of one way ratcheting teeth 39 disposed exteriorly therearound and facing companion ratcheting teeth 40a on the body lock ring 40. When the apparatus is shifted to activate the seal assembly into expanded position within the well to sealing securement relative to the inner wall of the casing C, the secondary piston sleeve 38 will move longitudinally relative to the body lock ring 40 causing the one way ratcheting teeth 39, 40a to ratchet relative to one another and secure the seal assembly 91 in expanded position and will prevent retraction of the seal assembly 91 and the slips 68, 69, until the apparatus is released, as described below.

During the setting procedure, described below, the lower end 40b of the body lock ring 40 will move relatively toward the top end 41a of a piston head 41 carried at the lowermost end of the secondary piston sleeve 38.

The piston head 41 has an effective operating area thereacross defined by the O-rings 42, 43 thereon.

The secondary piston sleeve 38 is secured against longitudinal movement relative to the piston cylinders 52, 58 through a plurality of locking dogs 45 housed initially in a bore 41b in the sleeve 38 below the piston head 41 and extending inwardly within a lock shoulder 44 on the central housing member 10.

Below the secondary piston sleeve 38 and contacting the lower end 46 of the sleeve 38 is a primary piston sleeve 50 having an upper end 47 initially abutting the lower end 46 of the sleeve 38. The sleeve 50 is held in place initially against relative longitudinal movement with respect to the housing of the apparatus by means of the abuttment contact between the ends 47, 46 and also by means of a shear ring 51 extending within a shear ring groove 51a on the primary piston sleeve 50. The shear ring 51 has a portion secured against the lower end of the piston cylinder 52, the piston cylinder 52, in turn, carrying within a groove 53 a split ring 54 carried lowerly of a shoulder 55 on a ring retainer 56 secured at threads 57 to the lower piston cylinder 58.

The primary piston sleeve 50 has an effective area thereacross defined by an O-ring 49 carried on the lowermost end of the sleeve 50 and O-ring 64 carried therebelow and on the lower piston cylinder 58.

Positioned between the rings 49, 64 and on the central housing member 10 is a setting pressure port 59 which receives application of tubing pressure applied across the piston area defined by the rings 49, 64 during the setting procedure, described below.

The central housing member 10 also receives a split ring 60 within a groove 61, the split ring 60 extending upon a shoulder 62 on the lower piston cylinder 58. The ring 60 resists effective relative longitudinal movement between the housing member 10 and cylinders 52, 58 until the actuating procedure is initiated.

The housing 10 also carries below the split ring 60 a shear ring 65 extending outwardly and housed between the lowermost end of the lower piston cylinder 58 and the upper cone member 66. During the setting procedure, the shear ring 65 will be the first shear member to separate during actuation.

The lowermost end of the central housing member 10 is secured at threads 79 to a key housing member 83 which has a groove 83a therein for receipt of a non rotation key member 80 which, in turn, is splined at 81 to a lower housing member 82 exteriorly thereof. The key housing 83 has a lower shoulder 83b which will prevent further upward longitudinal movement of a sleeve 85 by interface of the shoulder 83b with the top 85b of the sleeve 85 during the shifting procedure to unset the apparatus, described below.

Figure 4A:
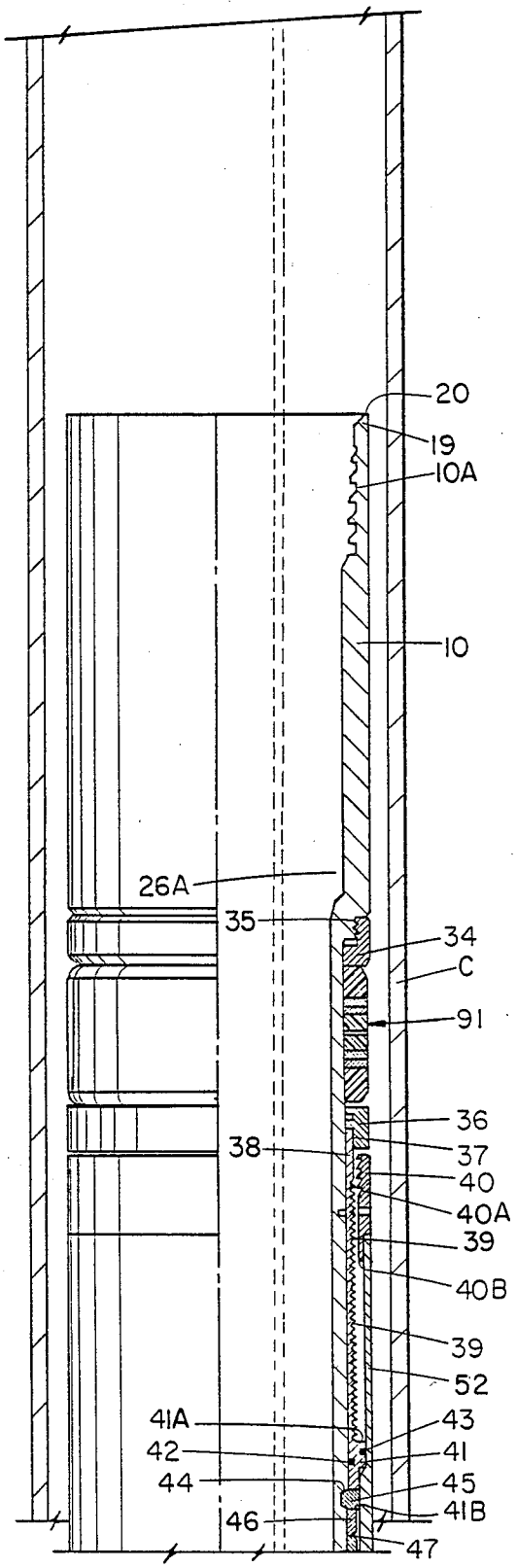
FIGS. 4A and 4B are a partial sectional illustration of the invention showing the release mechanism in released condition.
Figure 4B:
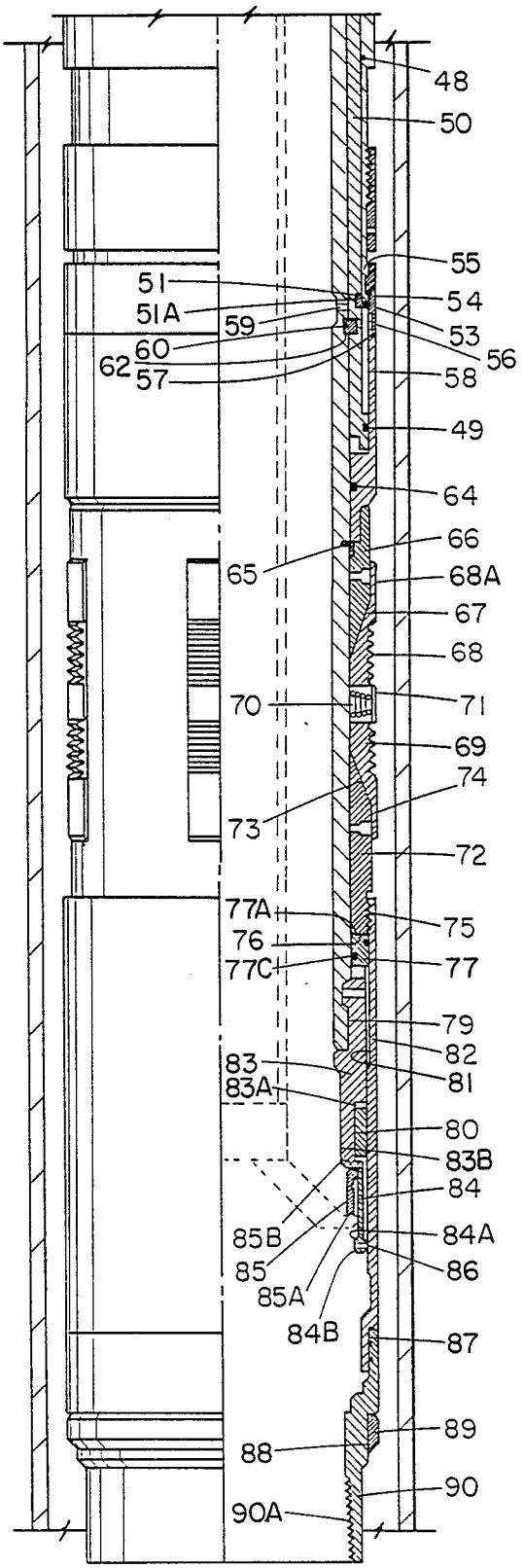
Figure 5A:
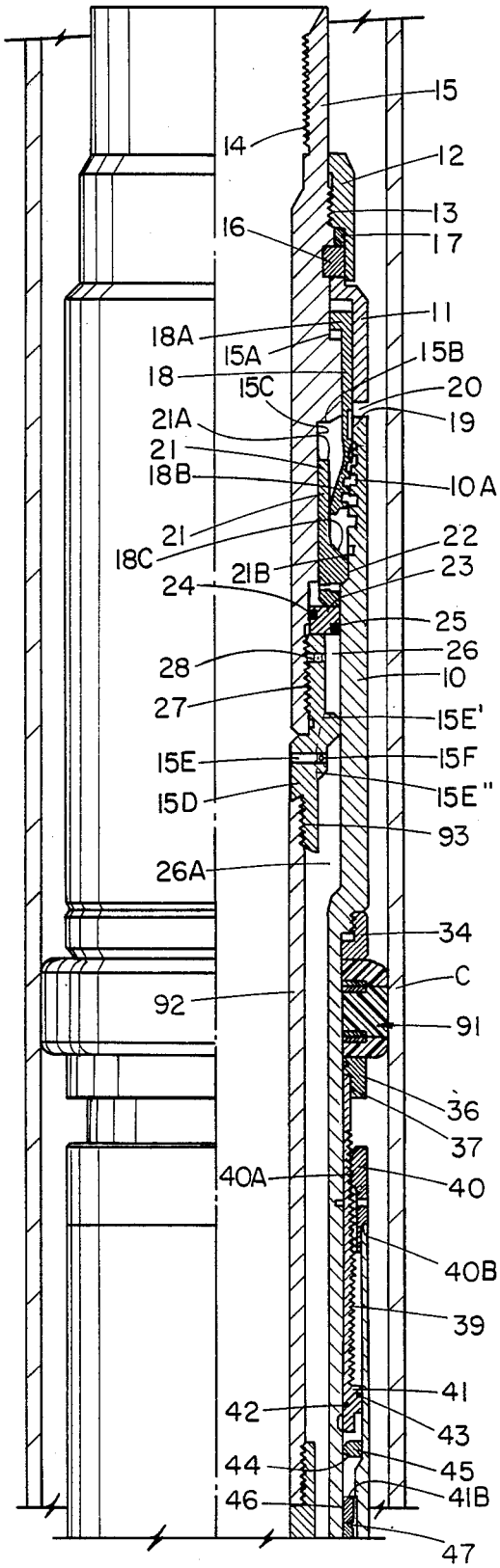
FIGS. 5A and 5B are a longitudinal partial sectional illustration of the present invention showing the emergency disengaging device in disengaged position.
Figure 5B:
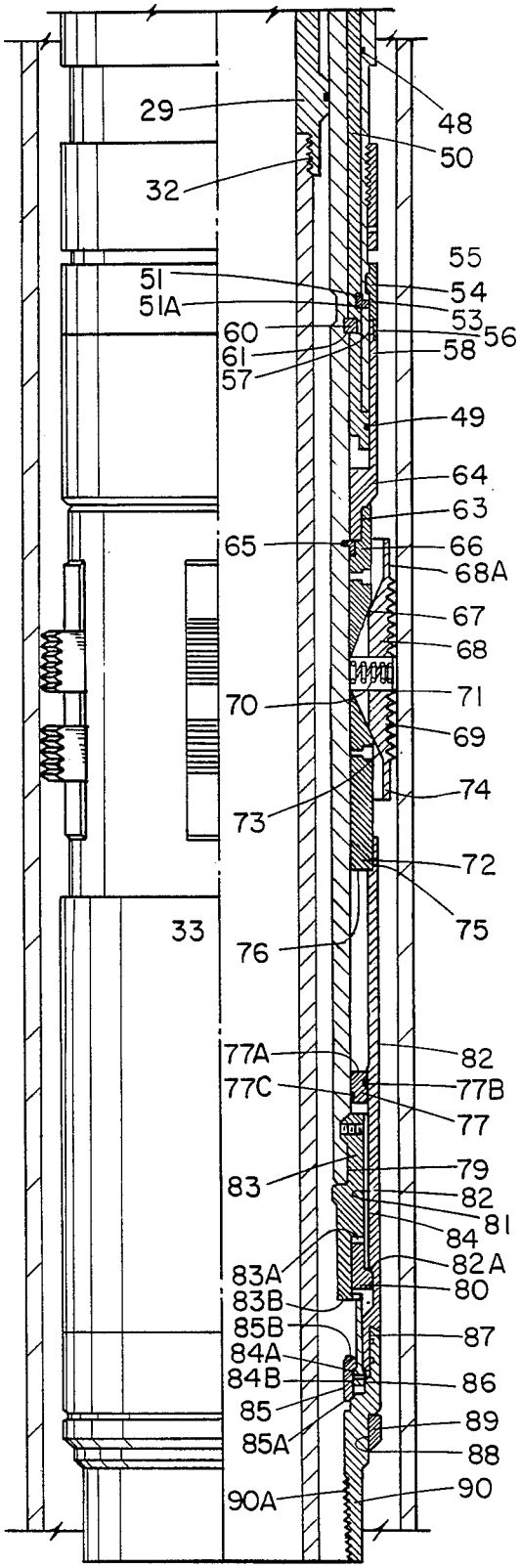

A collet 84 extends downwardly of the key housing 83 and has a head 84b protruding toward the lower housing member 82 for initial securement on a lock surface 82a of the lower housing member 82 by means of the surface 84a on the collet head 84b. The collet head 84b is shear pinned at 86 to the sleeve 85 cylindrically disposed interiorly around the collet head 84b. During disengagement and release of the apparatus, an auxiliary conduit, such as continuous coiled tubing, or a smaller workstring, or the like, is disposed within the workstring WS and has a release mechanism (FIGS. 4A, 4B) having a prong extending thereon for engagement onto the latch surface 85a of the sleeve 85. Upon pulling of the prong, the sleeve 85 will be urged upwardly, shearing the pin 86, and moving the sleeve 85 unitl interface of the shoulders 83b and 84a to permit the collet head 84b to flex inwardly, thus releasing the cylinders 58, 52, and ring 40 from the central housing member 10 and its companion parts to move the upper slip expander 67 to contract the slips 68, 69 and retract the seal assembly 91 for retrieval of the apparatus to the top of the well W.

The lower piston cylinder 58 is secured at threads 63 to an upper cone member 66 having a lowerly extending profiled ramp 67 for interface with a companion ramp on the upper slips 68. An upper slip retainer 68a is disposed around the exterior of the cone 66 for securement of the slips 68 at their uppermost end, the slips 68 and 69 also being secured in place by means of a retainer 71 urged outwardly by means of a spring member 70 to permit the slips to "rock" into place during the anchoring procedure. The lower slips 69 are urged outwardly during the setting operation by means of the ramp 73 on the lower cone 72, a lower slip retainer 74 being disposed around the exterior of the lower cone 72.

During the setting procedure, the lower end 76 of the lower cone 72 will be moved toward the upper face 77*a* of a seal piston member 77 housed between the central housing member 10 and the lower housing member 82. The lower housing member 82 is secured by means of threads 75 to the lower cone 72 with an annulus port 78 being provided above the seal piston 77. The seal piston 77 prevents fluid communication between the lower housing member 82 and the central housing member 10 by means of the seal 77*b*, 77*c* carried thereon. The lower housing member 82 is secured by means of threads 87 to a lower housing section 90 having, in turn, threads 90*a* for securement to a tubular extension thereon. A lower gauge ring 89 is carried exteriorly around the lower housing section 90 and is secured thereto by means of threads 88.

OPERATION

After the production packer PP has been positioned within the well W at its desired location, a plug (not shown) is run into the well on wireline or auxiliary conduit and implaced therein at a position below the production packer PP. Thereafter, pressure is applied through the interior of the workstring WS and the interior of the production packer PP and is introduced between the effective piston area defined by the rings 64, 49 through the setting pressure port 59 until the shear strength of the shear ring 65 is overcome, whereby the shear ring 65 will part and permit the cylinders 52 and 58 to move downwardly relative to the stabilized central housing member 10. The setting ramp 67 of the upper cone 66 will slide under the upper slips 68 and will cause the lower slips 69 to ride on the ramp 73 of the lower cone 72, thus urging the slips 68, 69 outwardly into anchoring and securing condition to resist movement of the production packer PP relative to the casing, the slip 68, 69 being dual acting, thus resisting movement of the production packer PP against longitudinal movement in either direction relative to the casing C.

Upon setting of the slip 68, 69, the cylinders 52, 58 will become stabilized relative to the central housing 10 and the pressure through the setting pressure port 59 will now be exerted on the primary piston sleeve 50 and, in turn, the piston head 41 to shear the shear ring 51. It will be appreciated that during the setting of the slip assembly, the piston cylinder 52 is moved downwardly relative to the piston head 41 permitting the locking dogs 45 to expand outwardly of the bore 41*b* releasing the central housing member 10 from the secondary piston sleeve 38 and the primary piston sleeve 50. As the primary piston sleeve 50 moves upwardly in tandem with the secondary piston sleeve 38, the setting pressure is transferred through the piston sleeves 38 and 50 to the lower gauge ring 36 which moves against the lower end of the seal assembly 91 to expand it into sealing expanded position along the smooth interior wall of the casing C, as the central housing 10 is stabilized against any longitudinal movement. During upward movement of the secondary piston sleeve 38, the one way ratcheting teeth 39 come into engagement with the companion ratcheting teeth 40*a* of the body lock ring 40 to effect a ratcheting movement such that the setting force defined through the pistons 50, 38 is locked into the seal assembly 91 and downward movement of the sleeve 38 is thereby prevented.

When it is desired to unseat the packer PP for any purpose after the setting procedure, an auxiliary wireline or other tool carried into the well on a line or auxiliary conduit, such as remedial coiled tubing can be extended into the packer PP until a prong (not shown) is secured against the surface 85*a* of the sleeve 85 and an upward pull is applied to said wireline or auxiliary tool to shear the pin 86 and shift the sleeve 85 upwardly until the surface 84*a* abuts the shoulder 83*b* of the key housing 83. The collet head 84*b* will flex inwardly, thus releasing the central housing member 10 and its associated parts from the seal assembly 91, slip 68, 69, etc. and the central housing member 10 and key housing 83 will be pulled upwardly until the upper face 77*a* of the seal piston 77 abuts the lower end 76 of the lower cone 72. During movement of the central housing member 10 upwardly, the upper cone 66 has been expanded away from the slips 68, causing the slips 68, 69 to retract and the seal assembly 91 to become unsealed from its position on the wall of the casing C. The packer PP in this expanded condition may be retrieved to the top of the well, along with other components secured thereto, directly or indirectly at threads 90*a*.

In the event that it is desired, for any reason, to disconnect the production packer PP from the workstring WS at any time, either prior to or after setting of the production packer PP, the differential between annulus pressure in the annulus pressure chamber 22 and the tubing pressure in the tubing pressure chamber 26 is varied to move the piston 23 away from the locking sleeve 21. Now, the collet 18, which is biased inwardly, will flex inwardly, separating the threads 10*a*, 18*b*, and the upper body member 15 and its associate parts, including the tubing extension 92, may be separated from the central housing member 10, with the keys 19 separating relative to the slots 20. The upper housing member 11 thus also will be removed from the central housing member 10 and carried to the top of the well with the upper body member 15.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A hydraulically set packer mechanism for use in a subterranean well, comprising:

(1) a tubular housing carryable in said well on a tubular conduit and telescopically positionable within a second conduit in said well;

(2) a seal assembly disposed around said housing and carried in said well in initially retracted position and activatable into expanded position within said well to sealing securement relative to the inner wall of said second conduit;

(3) anchoring means for securing said packer mechanism in position within said second conduit and activatable to securing condition to resist movement of said packer mechanism relative to said second conduit in at least one direction;

(4) first and second cylindrical members of said tubular housing movable in a first direction to actuate one of said seal assembly and said anchoring means into engagement with said second conduit; and (5) primary and secondary piston means carried within said cylindrical members and tandemly arranged for movement in a second direction to activate the other of said seal assembly and said anchoring means and responsive to pressure introduced through said tubular conduit for said actuation, each of said piston means being selectively secured against longitudinal movement relative to said housing and selectively secured against longitudinal movement relative to each other, said primary piston being released relative to said housing upon application of hydraulic presure across one of said piston means prior to release of said secondary piston relative to said housing whereby upon release of said piston means relative to said housing, said piston means and said cylinder members are movable to actuate said seal assembly to expanded position and said anchoring means to securing condition.

2. The apparatus of claim 1 further comprising means for securing said seal assembly in expanded position and said anchoring means in securing condition.

3. The apparatus of claim 2 wherein said securing means comprises a first ratcheting member carried on one of said cylindrical members and a second ratcheting member carried on one of said piston means for selective ratcheting engagement with said first ratcheting member upon movement of said piston means in said second direction and preventing movement of said piston means in said first direction when said ratcheting members are in companion engagement.

4. The apparatus of claims 1, 2 or 3 further comprising means carried on said tubular housing and responsive to mechanical manipulation to release said seal assembly from expanded position and said anchoring means from securing condition and for retrieval of said apparatus from said subterranean well.

5. The apparatus of claims 1, 2 or 3 further comprising means carried on said tubular housing and responsive to mechanical manipulation to release said seal assembly from expanded position and said anchoring means from securing condition and for retrieval of said apparatus from said subterranean well, said mechanical manipulation being longitudinal manipulation of an auxiliary tubular member disposed through the tubular conduit.

6. The apparatus of claims 1, 2 or 3 further comprising means carried on said tubular housing and responsive to mechanical manipulation to release said seal assembly from expanded position and said anchoring means from securing condition and for retrieval of said apparatus from said subterranean well, said means comprising a collet member secured against longitudinal movement relative to said housing by a shear releasable sleeve member interiorly disposed around said collet member.

7. The apparatus of claims 1, 2 or 3 further comprising means carried on said tubular housing and responsive to mechanical manipulation to release said seal assembly from expanded position and said anchoring means from securing condition and for retrieval of said apparatus from said subterranean well, said means comprising a collet member secured against longitudinal movement relative to said housing by shear a releasable sleeve member interiorly disposed around said collet member, and further comprising means to prevent relative rotational movement between said collet member and said tubular housing.

8. A hydraulically set packer mechanism securable within a substantially horizontal section of a vertically positioned subterranean well, comprising:

(1) a tubular housing carryable in said well on a tubular conduit and telescopically positionable within a second conduit in said well;

(2) a seal assembly disposed around said housing and carried in said well in initially retracted position and activatable into expanded position within the horizontal section of said well to sealing securement relative to the inner wall of said second conduit;

(3) anchoring means for securing said packer mechanism within the horizontal section of said subterranean well in position within said second conduit and activatable to securing condition within said horizontal section to resist movement of said packer mechanism relative to said second conduit in at least one direction;

(4) first and second cylindrical members of said tubular housing movable in a first direction to actuate one of said seal assembly and said anchoring means into engagement with said second conduit; and (5) primary and secondary piston means carried within said cylindrical members and tandemly arranged for movement in a second direction to activate the other of said seal assembly and said anchoring means and responsive to pressure introduced through said tubular conduit for said actuation, each of said piston means being selectively secured against longitudinal movement relative to said housing and selectively secured against longitudinal movement relative to each other, said primary piston being released relative to said housing prior to release of said secondary piston relative to said housing, whereby upon release of said piston means relative to said housing, upon application of hydraulic pressure across one of said piston means, said piston means and said cylinder members are movable to actuate said seal assembly and said anchoring means.

9. A hydraulically set packer mechanism for use in a horizontal section of a subterranean well, comprising:

(1) a tubular housing carryable in said well on a tubular conduit telescopically positionable within a second conduit in said well;

(2) an inner mandrel operatively communicable with said tubular conduit at one end and extending to a tubing conveyed perforating gum at the other end;

(3) a seal assembly disposed around said housing by application of hydraulic pressure across one of said piston means and carried in said well initially retracted position and activatable into expanded position within said well to sealing securement relative to the inner wall of said second conduit;

(4) anchoring means for securing said packer mechanism in position within said second conduit and activatable to securing condition to resist movement of said packer mechanism relative to said second conduit in at least one directiion;

(5) first and second cylindrical members of said tubular housing movable in a first direction to actuate one of said seal assembly and said anchoring means into engagement with said second conduit; and (6) primary and secondary piston means carried within said cylindrical members and tandemly arranged for movement in a second direction to active the other of said seal assembly and said anchoring means and responsive to pressure introduced through said tubular conduit for said actuation, each of said piston means being selectively secured against longitudinal movement relative to said housing and selectively secured against longitudinal movement relative to each other, said primary piston being released relative to said housing prior to release of said secondary piston relative to said housing, whereby upon release of said piston means relative to said housing, said piston means and said cylinder members are movable to actuate said seal assembly and said anchoring means.

10. The apparatus of claim 9 further comprising means for securing said seal assembly in expanded position and said anchoring means in securing condition.

11. The apparatus of claim 10 wherein said securing means comprises a first ratcheting member carried on one of said cylindrical members and a second ratcheting member carried on one of said piston means for selective ratcheting engagement with said first ratcheting member upon movement of said piston means in said second direction and preventing movement of said piston means in said first direction when said ratcheting members are in companion engagement.

12. The apparatus of claims 9, 10 or 11 further comprising means carried on said tubular housing and responsive to mechanical manipulation to release said seal assembly from expanded position and said anchoring means from securing condition and for retrievel of said apparatus from said subterranean well.

13. The apparatus of claims 9, 10 or 11 further comprising means carried on said tubular housing and responsive to mechanical manipulation to realease said seal assembly from expanded position and said anchoring means from securing condition and for retrieval of said apparatus from said subterranean well, said mechanical manipulation being longitudinal manipulation of an auxiliary tubular member disposed through the tubular conduit.

14. The apparatus of claims 9, 10 or 11 further comprising means carried on said tubular housing and responsive to mechanical manipulation to release said seal assembly from expanded position and said anchoring means from securing condition and for retrieval of said apparatus from said subterranean well, said means comprising a collet member secured against longitudinal movement relative to said housing by shear releasable sleeve member interiorly disposed around said collet member.

15. The apparatus of claims 9, 10 or 11 further comprising means carried on said tubular housing and responsive to mechanical manipulation to release said seal assembly from expanded position and said anchoring means from securing condition and for retrieval of said apparatus from said subterranean well, said means comprising a collet member secured against longitudinal movement relative to said housing by shear releasable sleeve member interiorly disposed around said collet member, and further comprising means to prevent relative rotational movement between said collect member and said tubular housing.

16. A method of activating a hydraulically set packer mechanism for use in a subterranean well, comprising:

(1) assembling on a tubular conduit to be introduced within said subterranean well and telescopically positionable within a second conduit in said well:

(a) a tubular housing carryable in said well on a tubular conduit;

(b) a seal assembly disposed around said housing and carried in said well in initially retracted position and activatable into expanded position within said well to seal securement relative to the inner wall of said second conduit;

(c) anchoring means for securing said packer mechanism in position within said second conduit and activatable to securing condition to resit movement of said packer mechanism relative to said second conduit in at least one direction;

(d) first and second cylindrical members of said tubular housing movable in a first direction to actuate on of said seal assembly and said anchoring means into engagement with said second conduit; and (e) primary and secondary piston means carried within said cylindrical members and tandemly arranged for movement in a second direction to activate the other of said seal assembly an said anchoring means an responsive to pressure introduced through said tubular conduit for said actuation, each of said piston means being selectively secured against longitudinal movement relative to said housing and selectively secured against longitudinal movement relative to each other, said primary piston being released relative to said housing prior to release of said secondary piston relative to said housing, upon application of hydraulic pressure across one of the piston means, whereby upon release of said piston means relative to said housing, said piston means and said cylinder members are movable to actuate said seal assembly and said anchoring means;

(2) running said tubular conduit withing said subterranean well and positioning said packer mechanism above the uppermost end of a producing section in said subterranean well and within a horizontal section of said subterranean well; and (3) increasing hydraulic pressure within said tubular conduit to move the first and second cylindrical members in a first direction and said primary and secondary piston means in a second direction to place said anchoring means in securing condition and said seal assembly in expanded position.

17. A method of activating a hydraulically set packer mechanism for use in a subterranean well, comprising:

(1) assembling on a tubular conduit to be introduced within said subterranean well and telescopically positionable within a second conduit in said well:

(a) a tubular housing carryable in said well on a tubular conduit;

(b) a seal assembly disposed around said housing and carried in said well in initially retracted position and activatable into expanded position within said well to seal securement relative to the inner wall of said second conduit;

(c) anchoring means for securing said packer mechanism in position within said second conduit and activatable to securing condition to resist movement of said packer mechanism relative to said second conduit in at least one direction;

(d) first and second cylinddrical members of said tubular housing movable in a first direction to actuate one of said seal assembly and said anchoring means into engagement with said second conduit; and (e) primary and secondary piston means carried within said cylindrical members and tandemly arranged for movement in a second dirction to activate the other of said seal assembly and said anchoring means and responsive to pressure introduced through said tubular conduit for said actuation , each of said piston means being selectively secured against longitudinal movement relative to said housing and selectively secured against longitudinal movement relative to each other, said primary piston being released relative to said housing prior to release of said secondary piston relative to said housing, by application of hydaraulic pressure across one of said piston means, whereby upon release of said piston means relative to said housing, said piston means and said cylinder members are movable to actuate said seal assembly and said anchoring means;

(f) means for securing said seal assembly in expanded position and said anchoring means in securing condition;

(2) runing said tubular conduit within said subterraneans well and positioning said packer mechanism above the uppermost end of a producing section in said subterranean well and within a horizontal section of said subterranean well; and (3) increasing hydraulic pressure within said tubular conduit to move the first and second cylindrical members in a first direction and said primary and secondary piston means in a second direction to place said anchoring means in securing condition and said seal assembly in expanded position.

18. A method of activating a hydraulically set packer mechanism for use in a subterranean well, comprising:

(1) assembling on a tubular conduit to be introduced within said subterranean well and telescopically positionable within a second conduit in said well:

(a) a tubular housing carryable in said well on a tubular conduit;

(b) a seal assembly disposed around said housing and carried in said well in initially retracted position and activatable into expanded position within said well to seal securement relative to the inner wall of said second conduit;

(c) anchoring means for securing said packer mechanism in position within said second conduit and activable to securing condition to resist movement of said packer mechanism relative to said second conduit in at least one direction;

(d) first and second cylindrical members of said tubular housing movable in a first direction to actuate one of said seal assembly and said anchoring means into engagement with said second conduit; and (e) primary and secondary piston means carried within said cylindrical members and tandemly arranged for movement in a second direction to active the other of said seal assembly and said anchoring means and responsive to pressure introduced through said tubular conduit for said actuation, each of said piston means being selective secured against longitudinal movement relative to said housing and selectively secured against longitudinal movement relative to each other, said primary piston being released relative to said housing prior to release of said secondary piston relative to said housing, whereby upon release of said piston means relative to said housing, upon application of hydraulic pressure across one of said piston means, said piston means and said cylinder members are movable to actuate said seal assembly and said anchoring means;

(2) running said tubular conduit within said subterranean well and positioning said packer mechanism above the uppermost end of a producing section in said subterranean well and within a horizontal section of said subterranean well;

(3) increasing hydraulic pressure within said tubular conduit to move the first and second cylindrical members in a first direction and said primary and secondary piston means in a second direction to place said anchoring means in securing condition and said seal assembly in expaned position; and (4) releasing said seal assembly from expanded position and said anchoring means from secured condition by introducing an auxiliary tubular member through said tubular conduit and said apparatus and engaging said auxiliary tubular member with said means responsive to mechanical manipulation to release said apparatus for longitudinal movement to move said apparatus to released positioned.

19. A method of activating a hydraulically set packer mechanism for use in a subterranean well, comprising:

(1) assembling on a tubular conduit to be introduced within said subterranean well and telescopically positionable within a second conduit in said well:

(a) a tubular housing carryable in said well on a tubular conduit;

(b) a seal assembly disposed around said housing and carried in said well in initially retracted position and activatable into expanded position within said well to seal securement relative to the inner wall of said second conduit;

(c) anchoring means for securing said packer mechanism in position within said second conduit and activatable to securing condition to resist movement of said packer mechanism relative to said second conduit in at least one direction;

(d) first and second cylindrical members of said tubular housing movable in a first direction to actuate one of said seal assembly and said anchoring means into engagement with said second conduit; and (e) primary and secondary piston means carried within said cylindrical members and tandemly arranged for movement in a second direction to active the other of said seal assembly and said activate the other of said seal assembly and said anchoring means and responsive to pressure introduced through said tubular conduit for said actuation, each of said piston means being selectively secured against longitudinal movement relative to said housing and selectively secured against longitudinal movement relative to each other, said primary piston being released relative to said housing prior to release of said secondary piston relative to said housing, upon application of hydarulic pressure across one of said piston means, whereby upon release of said piston means relative to said housing, said piston means and said cylinder members are movable to actuate said seal assembly and said anchoring means;

(f) means for securing said seal assembly in expanded position and said anchoring means in securing condition;

(2) running said tubular conduit within said subterranean well and positioning said packer mechanism above the uppermost end of a producing section in said subterranean well and within a horizontal section of said subterranean well;

(3) increasing hydraulic pressure within said tubular conduit to move the first and second cylindrical members in a first direction and said primary and secondary piston means in a second direction to place said anchoring means in securing condition and said seal assembly in expanded position; and (4) releasing seal assembly from expaned position and said anchoring means from secured condition by introducing an auxiliary tubular member through said tubular conduit and said apparatus and engaging said auxiliary tubular member with said means responsive to mechanical manipulation to release said apparatus for longitudinal movement to move said apparatus to released positioned.

20. In a packer assembly carryable on a tubular conduit for use in a subterranean well, said packer assembly having seal means disposed around said apparatus and carried in said well in initially retracted position and activatable into expanded position within said well to sealing securement relative to the inner wall of a second conduit, said packer assembly having anchoring means for securing said packer assembly in position within said second conduit and activatable to securing condition to resist movement of said packer assembly relative to said second conduit in at least one direction, and hydraulically activatable means to actuate said seal means into expanded position and said anchoring means into securing condition, a disconnect system, comprising;

(1) upper and lower outer housing members, the lower of said housing members comprising a housing of said packer element;

(2) key and slot means interengagingly juxtapositioned around said housing member for preventing relative rotational movement therebetween;

(3) a collet assembly positioned interiorly of said housing members and carried with said upper housing member by said tubular conduit and latchingly securing said housing members together; and (4) a lock sleeve responsive to annulus/tubing pressure differential and hydraulically urgeable against said collet assembly to urge said collet assembly in latchingly secured positioned and shiftable by a variation in pressure within said tubular conduit to release said lock sleeve relative to said collet assembly and release said upper housing member from said lower housing member.

21. A hydraulically set packer mechanism for use in a subterranean well, comprising:

(1) a tubular housing carryable in said well on a tubular conduit and telescopically positionable within a second conduit in said well;

(2) a seal assembly disposed around said housing and carried in said well in initially retracted position and activatable into expanded position within said well to seal securement relative to the inner wall of said second conduit;

(3) anchoring means for securing said packer mechanism in position within said second conduit and activatable to securing condition to resist movement of said packer mechanism relative to said second conduit in at least one direction;

(4) first and second cylindrical members of said tubular housing movable in a first direction to acctuate one of said seal assembly and said anchoring means into engagement with said second conduit;

(5) primary and secondary piston means carried within said cylindrical memebers and tandemly arranged for movement in a second direction to activate the other of said seal assembly and said anchoring means and responsive to pressure introduced through said tubular conduit for said actuation, each of said piston means being selectively secured against longitudinal movement relative to said housing and selectively secured against longitudinal movement relative to each other, said primary piston being released relative to said housing prior to release of said secondary piston relative to said housing, whereby upon release of said piston means relative to said housing, upon application of hydraulic pressure across one of said piston means, said piston means and said cylinder members are movable to actuate said seal assembly and said anchoring means;

(6) upper an lower outer housing members, the lower of said housing members comprising a housing of said packer element;

(7) key and slot means interengagingly juxtapositioned around said housing members for preventing relative rotational movement therebetween;

(8) a collet assembly positioned interiorly of said housing members and carried with said upper housing member by said tubular conduit and latchingly securing said housing members together; and (9) a lock sleeve responsive to annulus/tubing pressure differential and hydraulically urgeable against said collet assembly to urge said collet assembly in latchingly secured positioned and shiftable by a variation in pressure within said tubular conduit to release said lock sleeve relative to said collet assembly and release said upper housing member from said lower housing member.

22. The apparatus of claim 21 further comprising means for securing said seal assembly in expanded position and said anchoring means in securing condition.

23. The apparatus of claim 22 wherein said securing means comprises a first ratcheting member carried on said tubular housing and a second ratcheting member carried on one of said piston means for selective ratcheting engagement with said first ratcheting member upon movement of said piston means in said second direction and preventing movement of said piston means in said first direction when said ratcheting members are in companion engagement.

24. The apparatus of claims 21, 22 or 23 further comprising means carried on said tubular housing and responsive to mechanical manipulation to release said seal assembly from expanded position and said anchoring means from securing condition and for retrieval of said apparatus from said subterranean well.

25. The apparatus of claims 21, 22, or 23 further comprising means carried on said tubular housing and responsive to mechanical manipulation to release said seal assembly from expanded position and said anchoring means from securing condition and for retrieval of said apparatus from said subterranean well, said mechanical manipulation being longitudinal manipulation of an auxiliary tubular member disposed through the tubular conduit.

26. The apparatus of claims 21, 22 or 23 further comprising means carried on said tubular housing and responsive to mechanical manipulation to release said seal assembly from expanded position and said anchoring means from securing condition and for retrieval of said apparatus from said subterranean well, said means comprising a collet member secured against longitudinal movement relative to said housing by shear releasable sleeve member interiorly disposed around said collet member.

27. The apparatus of claims 21, 22 or 23 further comprising means carried on said tubular housing and responsive to mechanical manipulation to release said seal assembly from expanded position and said anchoring means from securing condition and for retrieval of said apparatus from said subterranean well, said means comprising a collet member secured against longitudinal movement relative to said housing by shear releasable sleeve member interiorly disposed around said collet member, and further comprising means to prevent relative rotational movement between said collet member and said tubular housing.

28. Method of actuating a disconnect assembly incorporated within a packer assembly carryable in a subterranean well on a tubular conduit, said packer assembly having a seal assembly disposed around a housing and carried in said well in initially retracted position and activatable into expanded postion within the well to sealing securement relative to the inner wall of a second conduit, said packer assembly having anchoring means for securing the packer assembly in position within the second conduit and activatable to securing condition to resist movement of the packer assembly relative to the second conduit in at least one direction and hydraulically activatable means to move the seal assembly to expanded position and the anchoring means to securing condition, comprising the steps of;

(A) securing to the uppermost end of said packer assembly prior to introduction of said packer assembly in said subterranean well:

(1) upper and lower outer housing members, the lower of said housing members comprising a housing of said packer assembly;

(2) key and slot means interengagingly juxtapositioned around said housing members for preventing relative rotational movement therebetween;

(3) a collet assembly positioned interiorly of said housing members and carried with said upper housing member by said tubular conduit and latchingly securing said housing members together;

(4) a lock sleeve responsive to annulus/tubing pressure differential and hydraulically urgeable against said collet assembly to urge said collet assembly in latchingly secured position and shiftable by a variation in pressure within said tubular conduit to release said lock sleeve relative to said collet assembly and release said upper housing member from said lower housing member; and (B) disconnecting said tubular conduit from said packer assembly either prior to or subsequent to the setting of said packer assembly within said subterranean well by causing a variation in pressure within said tubular conduit to release said lock sleeve relative to said collet assembly and release said upper housing member from said lower housing member.

* * * * *